US007015633B2

(12) United States Patent
Makino et al.

(10) Patent No.: US 7,015,633 B2
(45) Date of Patent: Mar. 21, 2006

(54) SPARK PLUG

(75) Inventors: Hiroaki Makino, Aichi-ken (JP); Nobuo Abe, Yokkaichi (JP)

(73) Assignee: Denso Corporation, Kariya (JP)

( * ) Notice: Subject to any disclaimer, the term of this patent is extended or adjusted under 35 U.S.C. 154(b) by 269 days.

(21) Appl. No.: 10/642,302

(22) Filed: Aug. 18, 2003

(65) Prior Publication Data

US 2004/0036395 A1 Feb. 26, 2004

(30) Foreign Application Priority Data

Aug. 22, 2002 (JP) ..... 2002-241838
May 9, 2003 (JP) ..... 2003-131922

(51) Int. Cl.
*H01T 13/20* (2006.01)

(52) U.S. Cl. ..... 313/141; 313/144

(58) Field of Classification Search ..... 313/141, 313/142, 144; 123/169 EL
See application file for complete search history.

(56) References Cited

U.S. PATENT DOCUMENTS

| | | | | |
|---|---|---|---|---|
| 6,166,480 | A | 12/2000 | Ishida et al. | |
| 6,215,234 | B1 | 4/2001 | Abe et al. | |
| 2002/0038992 | A1 * | 4/2002 | Morita et al. | 313/141 |
| 2002/0070645 | A1 * | 6/2002 | Chiu et al. | 313/141 |
| 2002/0109447 | A1 * | 8/2002 | Hanashi et al. | 313/123 |

* cited by examiner

*Primary Examiner*—Ashok Patel
(74) *Attorney, Agent, or Firm*—Nixon & Vanderhye P.C.

(57) ABSTRACT

A noble metallic firing tip includes a protruding portion which is formed partly on its outer circumferential surface so as to protrude in the direction substantially normal to the axis of a center electrode. The protruding portion is disposed in confronting relationship via a discharge gap with a distal end of an opposed portion of a ground electrode far from its leg portion.

8 Claims, 15 Drawing Sheets

FIG. 2
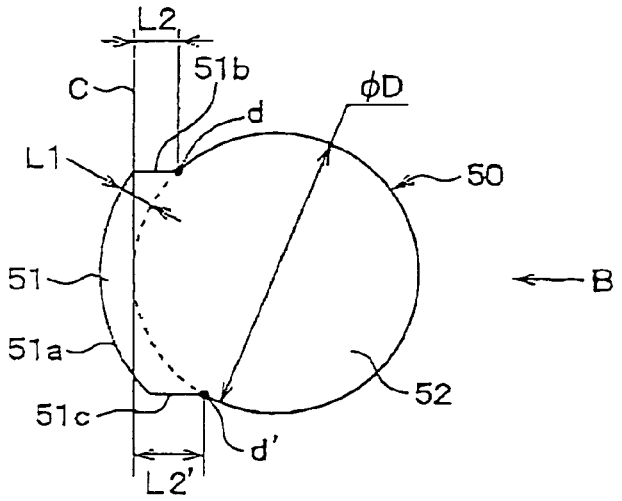
FIG. 3
| | PRIOR ART | ① | ② | ③ | ④ | ⑤ | ⑥ |
|---|---|---|---|---|---|---|---|
| L1 (mm) | 0 | 0.01 | 0.1 | 0.2 | 0.1 | 0.01 | 0.01 |
| L2 / D | 0 | 0.5 | 0.5 | 0.5 | 0.1 | 0.1 | 0.1 |
| L2' / D | 0 | 0.5 | 0.5 | 0.5 | 0.5 | 0.1 | 0.1 |
| H1 (mm) | 0 | 0.1 | 0.1 | 0.1 | 0.1 | 0.1 | 0.3 |
| SYMBOL | ● | ○ | △ | □ | ◇ | × | ▲ |
FIG. 4
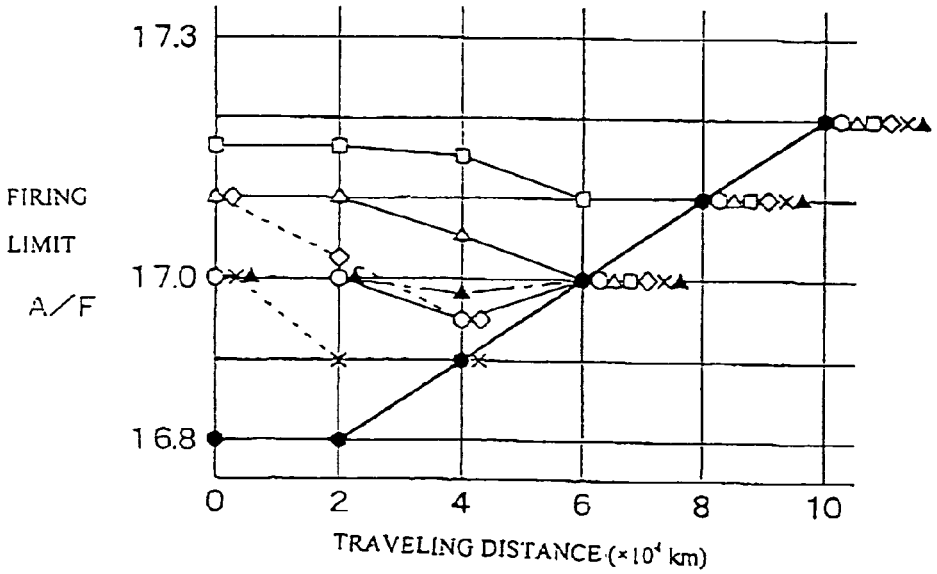

FIG. 5
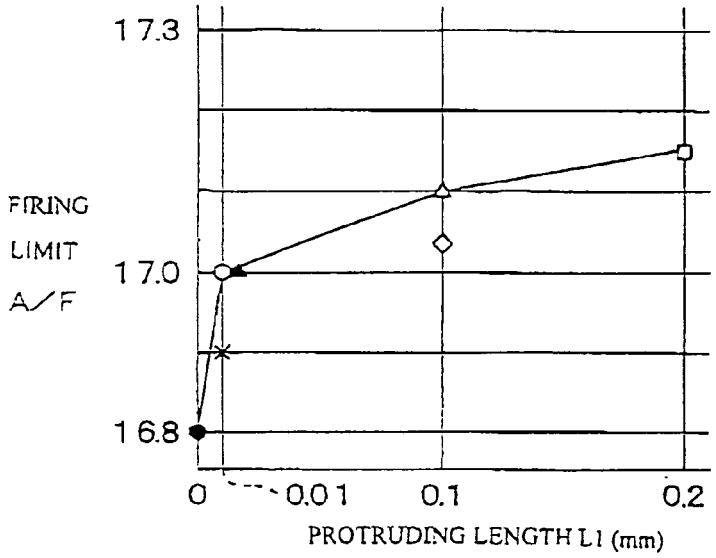
FIG. 6
| | PRIOR ART | ① | ② | ③ | ④ | ⑤ | ⑥ |
|---|---|---|---|---|---|---|---|
| L1 (mm) | 0 | 0.01 | 0.1 | 0.2 | 0.1 | 0.01 | 0.01 |
| L2/D | 0 | 0.5 | 0.5 | 0.5 | 0.1 | 0.1 | 0.1 |
| L2'/D | 0 | 0.5 | 0.5 | 0.5 | 0.5 | 0.1 | 0.1 |
| H1 (mm) | 0 | 0.1 | 0.1 | 0.1 | 0.1 | 0.1 | 0.3 |
| SYMBOL | ● | ○ | △ | □ | ◇ | × | ▲ |
FIG. 7
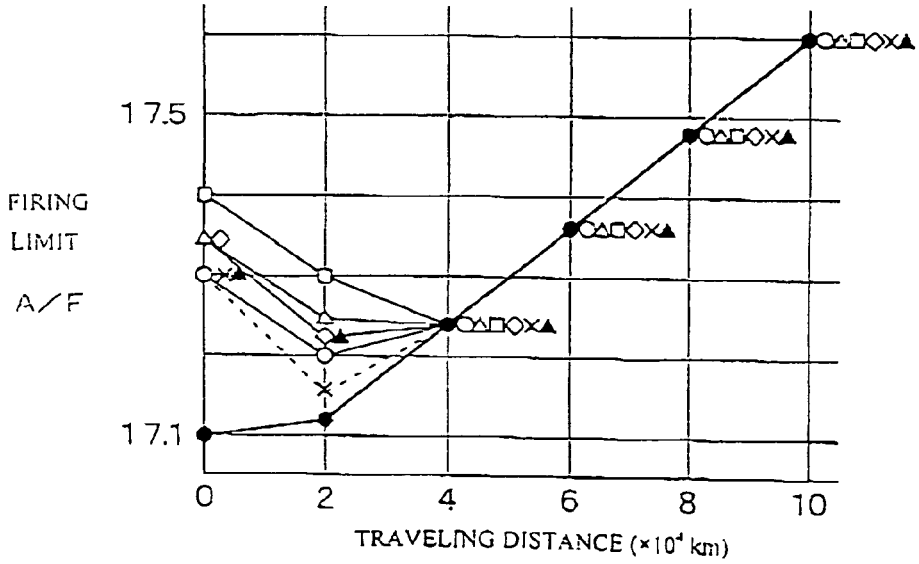

FIG. 12

| | PRIOR ART (0) | ① | ② | ③ | ④ | ⑤ | ⑥ | ⑦ | ⑧ |
|---|---|---|---|---|---|---|---|---|---|
| $\Delta W_{CM}$ ($\mu$m) | 0 | 0 | 0 | 0 | 0 | 0 | 0 | 0 | −50 |
| L3 / D | 0 | 0.3 | 0.3 | 0.3 | 0.3 | 0.1 | 0.1 | 0.5 | 0.1 |
| L3′ / D | 0 | 0.3 | 0.3 | 0.3 | 0.3 | 0.1 | 0.5 | 0.5 | 0.1 |
| $\Delta Rz$ ($\mu$m) | 4≧ | 20 | 200 | 400 | 600 | 20 | 20 | 20 | 20 |
| SYMBOL | ● | ○ | △ | □ | ◇ | ▲ | ■ | ◆ | × |

FIG. 15

| | PRIOR ART ⓪ | ① | ② | ③ | ④ | ⑤ | ⑥ | ⑦ | ⑧ |
|---|---|---|---|---|---|---|---|---|---|
| ΔWCM (μm) | 0 | 0 | 0 | 0 | 0 | 0 | 0 | 0 | −50 |
| L3 / D | 0 | 0.3 | 0.3 | 0.3 | 0.3 | 0.1 | 0.1 | 0.5 | 0.1 |
| L3' / D | 0 | 0.3 | 0.3 | 0.3 | 0.3 | 0.1 | 0.5 | 0.5 | 0.1 |
| ΔRz (μm) | 4≧ | 20 | 200 | 400 | 600 | 20 | 20 | 20 | 20 |
| SYMBOL | ● | ○ | △ | □ | ◇ | ▲ | ■ | ◆ | × |

FIG. 21
| | PRIOR ART ⓪ | ① | ② | ③ | ④ | ⑤ | ⑥ |
|---|---|---|---|---|---|---|---|
| r·max (mm) | 0 | 0.05 | 0.10 | 0.15 | 0.20 | 0.05 | 0.05 |
| L4/D | 0 | 0.5 | 0.5 | 0.5 | 0.5 | 0.5 | 0.8 |
| L4'/D | 0 | 0.5 | 0.5 | 0.5 | 0.5 | 0.8 | 0.8 |
| SYMBOL | ● | ○ | △ | □ | ◇ | ▲ | ■ |
FIG. 22
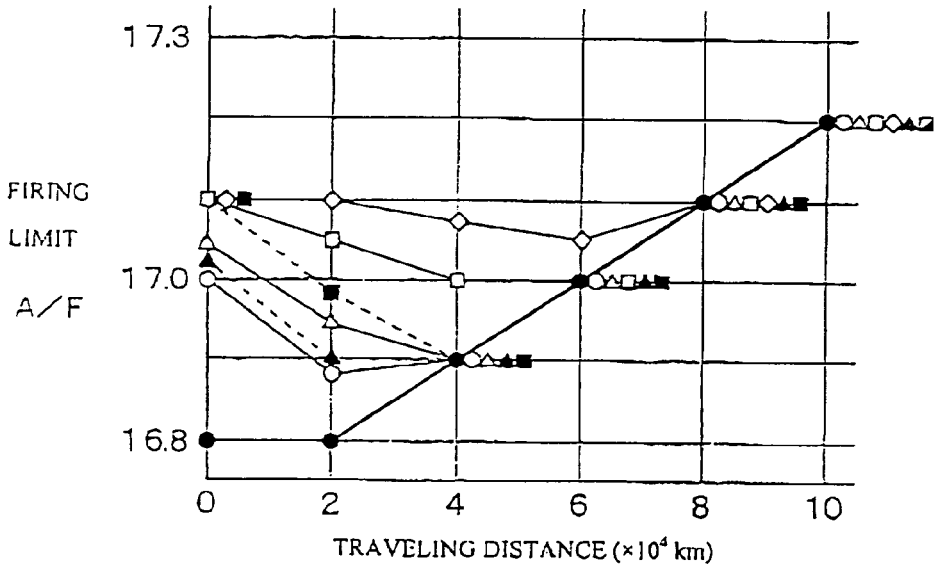
FIG. 23
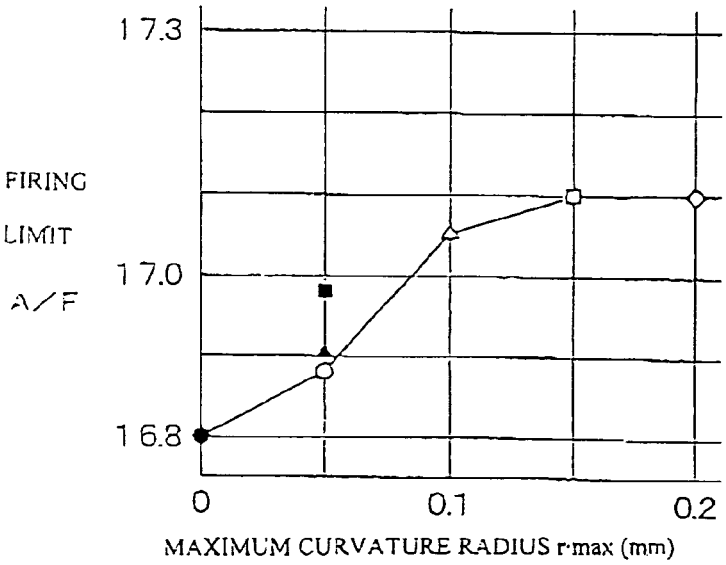

FIG. 24
| | PRIOR ART ⓪ | ① | ② | ③ | ④ | ⑤ | ⑥ |
|---|---|---|---|---|---|---|---|
| r*max (mm) | 0 | 0.05 | 0.10 | 0.15 | 0.20 | 0.05 | 0.05 |
| L4／D | 0 | 0.5 | 0.5 | 0.5 | 0.5 | 0.5 | 0.8 |
| L4'／D | 0 | 0.5 | 0.5 | 0.5 | 0.5 | 0.8 | 0.8 |
| SYMBOL | ● | ○ | △ | □ | ◇ | ▲ | ■ |
FIG. 25
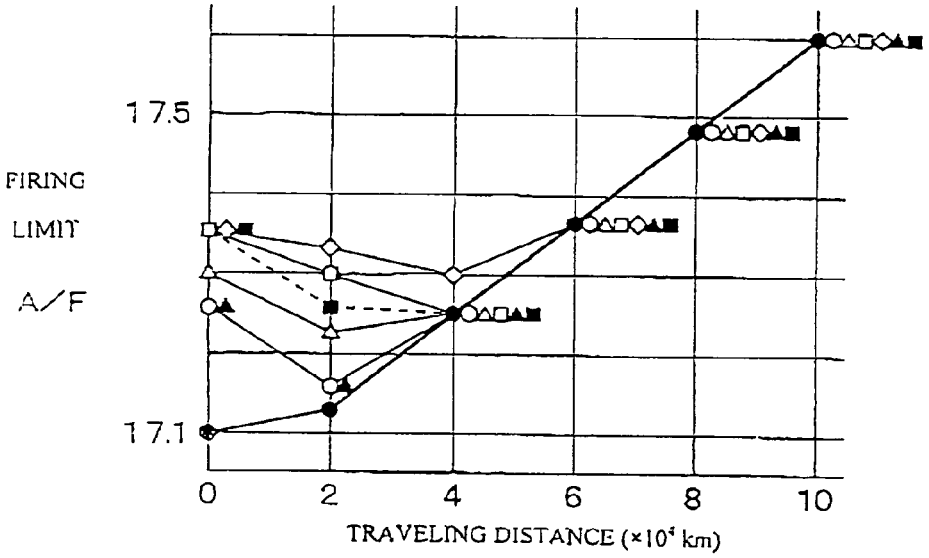
FIG. 26
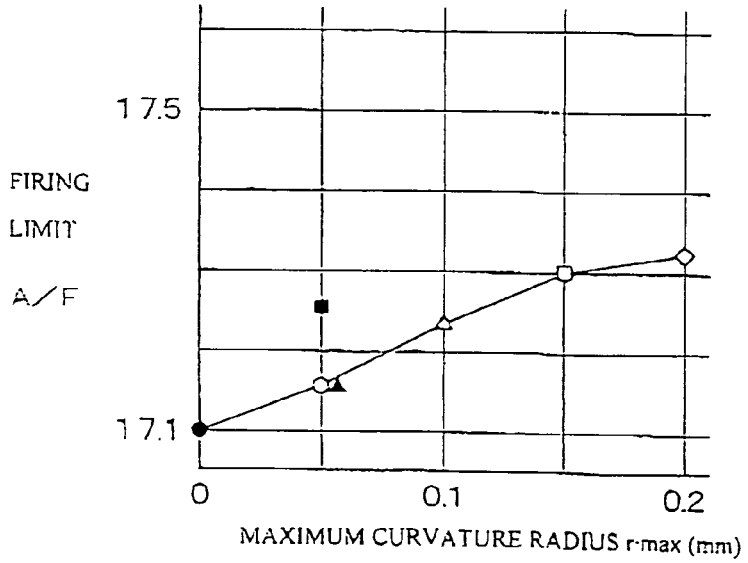

SPARK PLUG

BACKGROUND OF THE INVENTION

This invention relates to a spark plug including a center electrode and a ground electrode disposed in a confronting relationship with a noble metallic firing tip fixed on an opposed portion of at least one of these electrodes.

A conventional spark plug includes a noble metallic firing tip, for example made of a Pt (platinum) alloy or an Ir (iridium) alloy, having excellent spark exhaustion resistance as a spark discharge electrode member disposed in a discharge gap defined between a center electrode and a ground electrode.

The spark plug employing a noble metallic firing tip electrode is advantageous in that the radial size of the electrode can be reduced. Furthermore, thinning the electrode brings the effect of reducing flame quenching function and accordingly assures higher ignitability.

In general, the growth of flame kernel formed during spark discharge determines the ignitability. The electrode, being a large heat mass, tends to cool the flame kernel and accordingly disturbs the growth of flame kernel. In this respect, the slender noble metallic firing tip electrode having a thinned diameter brings desirable effect of suppressing the flame kernel cooling function of the electrode.

However, according to the conventional spark plug, the flame kernel does not grow from the same position. For example, the flame kernel may grow from a portion of the discharge surface being offset toward the leg of the ground electrode or, in alternative, from an opposite portion being offset toward a distal end of the ground electrode.

When the flame kernel is formed at the distal end side of the ground electrode, the growth of flame kernel is relatively smooth and easy because the flame kernel is not so severely subjected to the above-described cooling function of the ground electrode. On the other hand, when the flame kernel is formed at the opposite side offset toward the leg (i.e., a proximal end) of the ground electrode, the growth of flame kernel is relatively difficult because the flame kernel is directly subjected to the above-described cooling function of the ground electrode (including its leg portion).

In general, the ignitability of a spark plug is improved when the discharge gap is widened. In other words, a brand-new spark plug has the worst ignitability. Similar tendency is recognized even in a spark plug employing a noble metallic firing tip electrode. Furthermore, this tendency is remarkably recognized when an initial setting of the discharge gap is short.

SUMMARY OF THE INVENTION

In view of the above-described problems of the prior art, the present invention has an object to provide a spark plug capable of assuring excellent ignitability without sacrificing the growth of flame kernel.

In order to accomplish the above and other related objects, the present invention provides a first spark plug including a cylindrical metal housing, a columnar center electrode insulated from the metal housing and supported inside the metal housing, and a ground electrode having a leg portion and an opposed portion. The leg portion of the ground electrode extends substantially parallel to an axis of the center electrode and is bonded to the metal housing at one end. The opposed portion of the ground electrode extends from the other end of the leg portion in a direction substantially normal to the axis of the center electrode so as to be opposed to a distal end of the center electrode. Furthermore, a columnar noble metallic firing tip is bonded to at least one of the distal end of the center electrode and the opposed portion of the ground electrode so as to form a discharge gap. According to the first spark plug, the metallic firing tip includes a protruding portion formed partly on an outer circumferential surface of the metallic firing tip so as to protrude in the direction substantially normal to the axis of the center electrode. And, the protruding portion is disposed in confronting relationship via the discharge gap with a distal end of the opposed portion of the ground electrode far from the leg portion.

According to this arrangement, the electric field in the discharge gap is relatively strong at a local portion where the protruding portion is formed. Thus, the flame kernel is formed at the distal end side of the ground electrode during spark discharge. The flame kernel can promptly and stably grow without being severely subjected to the cooling function of the ground electrode including its leg portion.

Preferably, a protruding length L1 of the protruding portion satisfies $0.01\ \text{mm} \leqq \mathbf{L1} \leqq 0.2\ \text{mm}$.

Furthermore, the present invention provides a second spark plug including a cylindrical metal housing, a columnar center electrode insulated from the metal housing and supported inside the metal housing, and a ground electrode having a leg portion and an opposed portion. The leg portion of the ground electrode extends substantially parallel to an axis of the center electrode and is bonded to the metal housing at one end. The opposed portion of the ground electrode extends from the other end of the leg portion in a direction substantially normal to the axis of the center electrode so as to be opposed to a distal end of the center electrode. Furthermore, a columnar noble metallic firing tip is bonded to at least one of the distal end of the center electrode and the opposed portion of the ground electrode so as to form a discharge gap. According to the second spark plug, the noble metallic firing tip has two regions differentiated in surface roughness and respectively serving as a discharge surface forming the discharge gap. One region of the noble metallic firing tip has a surface roughness larger than that of the other region and is disposed in confronting relationship via the discharge gap with a distal end of the opposed portion of the ground electrode far from the leg portion.

According to this arrangement, the electric field in the discharge gap is relatively strong at the region having a relatively large surface roughness. Thus, the flame kernel is formed at the distal end side of the ground electrode during spark discharge. The flame kernel can promptly and stably grow without being severely subjected to the cooling function of the ground electrode including its leg portion.

Preferably, a difference between the two regions of the noble metallic firing tip exceeds 4 $\mu$m in a ten-point average roughness.

Furthermore, the present invention provides a third spark plug including a cylindrical metal housing, a columnar center electrode insulated from the metal housing and supported inside the metal housing, and a ground electrode having a leg portion and an opposed portion. The leg portion of the ground electrode extends substantially parallel to an axis of the center electrode and is bonded to the metal housing at one end. The opposed portion of the ground electrode extends from the other end of the leg portion in a direction substantially normal to the axis of the center electrode so as to be opposed to a distal end of the center electrode. Furthermore, a columnar noble metallic firing tip is bonded to at least one of the distal end of the center electrode and the opposed portion of the ground electrode so as to form a discharge gap. According to the third spark plug, the noble metallic firing tip includes a chamfered portion formed partly along an outer cylindrical periphery of a discharge surface and positioned closely to the leg portion of the ground electrode.

According to this arrangement, the electric field in the discharge gap is relatively weak at the chamfered portion. Thus, the flame kernel is formed at the distal end side of the ground electrode during spark discharge. The flame kernel can promptly and stably grow without being severely subjected to the cooling function of the ground electrode including its leg portion.

Preferably, a maximum curvature radius r·max of the chamfered portion satisfies 0.05 mm≦r·max.

Furthermore, in each of the first to third spark plug, it is preferable that the noble metallic firing tip is made of an iridium (Ir) alloy or a platinum (Pt) alloy.

Furthermore, it is preferable that the noble metallic firing tip is formed by shearing a material rod into a piece having a predetermined length.

This is advantageous in easily manufacturing the above-described noble metallic firing tip equipped with the protruding portion or the above-described noble metallic firing tip having two regions differentiated in surface roughness.

BRIEF DESCRIPTION OF THE DRAWINGS

The above and other objects, features and advantages of the present invention will become more apparent from the following detailed description which is to be read in conjunction with the accompanying drawings, in which:

FIG. 2 is a plan view showing a noble metallic firing tip shown in FIG. 1, seen from the direction of an arrow A;

FIG. 3 is a table showing dimensions of test samples used in an evaluation test;

FIG. 4 is a graph showing evaluation result obtained with respect to ignitibility through the evaluation test;

FIG. 5 is a graph showing test result representing a relationship between protruding length and ignitability;

FIG. 6 is a table showing dimensions of test samples used in an evaluation test;

FIG. 7 is a graph showing evaluation result obtained with respect to ignitibility through the evaluation test;

FIG. 12 is a table showing dimensions of test samples used in an evaluation test;

FIG. 15 is a table showing dimensions of test samples used in an evaluation test;

FIG. 21 is a table showing dimensions of test samples used in an evaluation test;

FIG. 22 is a graph showing evaluation result obtained with respect to ignitibility through the evaluation test;

FIG. 23 is a graph showing test result representing a relationship between maximum curvature radius and ignitability;

FIG. 24 is a table showing dimensions of test samples used in an evaluation test;

FIG. 25 is a graph showing evaluation result obtained with respect to ignitibility through the evaluation test;

FIG. 26 is a graph showing test result representing a relationship between maximum curvature radius and ignitability.

DESCRIPTION OF THE PREFERRED EMBODIMENTS

Preferred embodiments of the present invention will be explained hereinafter with reference to attached drawings.

First Embodiment

Figure 1:
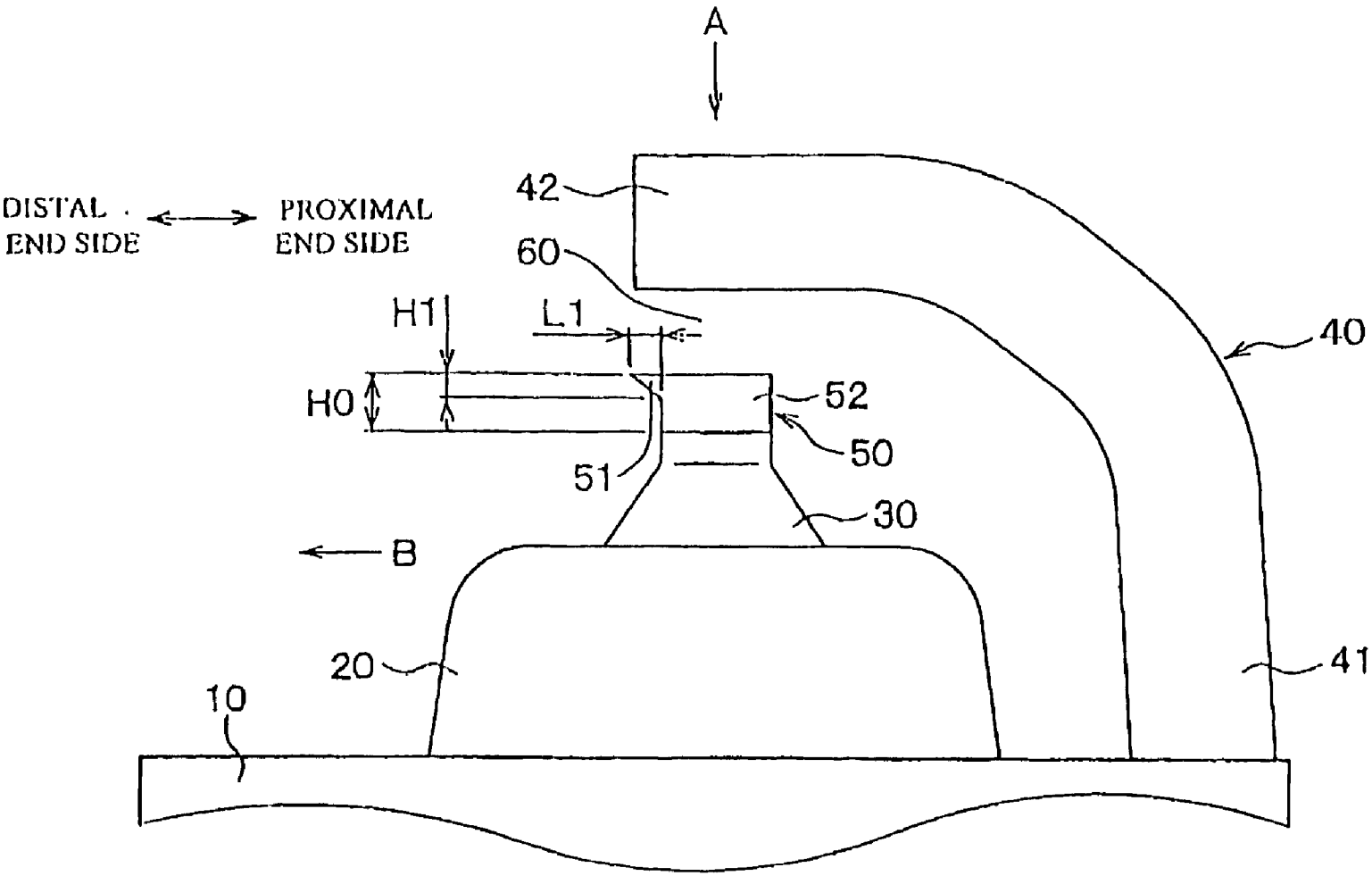
FIG. 1 is a side view showing an essential part of a spark plug in accordance with a first embodiment of the present invention.

FIG. 1 is a side view showing an essential part of a spark plug in accordance with a first embodiment of the present invention. FIG. 2 is a plan view showing a noble metallic firing tip 50 shown in FIG. 1, seen from the direction of an arrow A.

In FIG. 1, the spark plug has a cylindrical metal housing 10 which is manufactured from low-carbon steel or a comparable electrically conductive steel member and is provided with a male threaded portion (not shown). The spark plug is firmly fixed to a cylinder head of an internal combustion engine by engaging the threaded portion of the metal housing into a screw hole of the cylinder head, so that a center electrode 30 and a ground electrode 40 are exposed into a combustion chamber of the engine.

A cylindrical insulator 20, made of an alumina ($Al_2O_3$) etc. having excellent insulation properties, is securely disposed inside the metallic housing 10. One end (i.e., distal end) of insulator 20 protrudes out of an axial end of the metallic housing 10.

The center electrode 30 is securely supported in an axial hole of the insulator 20. In other words, the center electrode 30 is insulated from the metallic housing 10 via the insulator 20. The center electrode 30 is a metallic rod member configured into a cylindrical shape including an internal layer made of Cu or a comparable metallic member having excellent thermal conductivity and an external layer made of a Ni-based alloy, a Fe-based alloy, a Co-based alloy, or a comparable metallic member possessing excellent heat resistance and corrosion resistance. One end of center electrode 30 protrudes out of the one end of insulator 20.

The ground electrode 40 is a metallic rod member configured into a curved square rod or the like and made of a Ni-based alloy. The ground electrode 40 includes a leg portion 41 extending substantially parallel to an axis of the center electrode 30 and an opposed portion 42 extending in a direction substantially normal to the axis of the center electrode 30. One end (proximal end side) of the leg portion 41 is welded to the metal housing 10. The other end of the leg portion 41 bends at its intermediate region and continuously changes or merges into the opposed portion 42 positioned at the distal end side of the ground electrode 40. The opposed portion 42 is opposed to the distal end (i.e., a top) of the center electrode 30 in the axial direction of the center electrode 30.

A noble metallic firing tip 50, made of an Ir (iridium) alloy, is bonded to the distal end of the center electrode 30 so as to serve as a spark discharge electrode member. A discharge gap 60 is formed between the noble metallic firing tip 50 and the opposed portion 42 of the ground electrode 40.

The noble metallic firing tip 50 is formed by shearing a thin and long material rod into a piece having a predetermined length. Through this shearing, a significant amount of shear drop (i.e., a protruding portion 51) is formed at a leading side of the noble metallic firing tip 50 in a shearing direction B. More specifically, the protruding portion 51 is formed partly on an outer circumferential surface of the noble metallic firing tip 50 so as to protrude in the direction substantially normal to the axis of the center electrode 30.

The protruding portion 51, when seen from a direction normal to the axis of the center electrode 30, has a tapered (more specifically, triangular in vertical cross section) configuration. Furthermore, as shown in FIG. 2, when seen from the axial direction of the center electrode 30, the protruding portion 51 has an arc edge 51*a* coaxial with but offset outward from an outer cylindrical surface of a main body 52 of the noble metallic firing tip 50. Furthermore, the protruding portion 51 has parallel side edges 51*b* and 51*c* each extending in the shearing direction B to connect the arc edge 51*a* of the protruding portion 51 to the outer cylindrical surface of the main body 52.

Furthermore, as shown in FIG. 1, the protruding portion 51 is disposed in confronting relationship via the discharge gap 60 with a distal end (i.e., a front end) of the opposed portion 42 of the ground electrode 40 far from its leg portion 41.

Ignitability of the above-described spark plug was evaluated using various test samples differentiated in the protruding length 1, protruding regions L2, L2', and protruding height H1.

The protruding length L1 is equal to a difference between a radius of an outermost periphery (i.e., arc edge 51*a*) of the protruding portion 51 and a radius of the main body 52 of the noble metallic firing tip 50. In other words, the protruding length L1 is an overhang of the protruding portion 51 from an outer cylindrical surface of the main body 52 in the direction normal to the axis of the center electrode 30. The protruding region L2 represents a clearance from a line C to a point d and the protruding region L2' represents a clearance from the line C to a point d', where the line C is a tangential line of the main body 52 normal to the shearing direction B and passing the leading edge of the main body 52, the point d represents the position where the side edge 51*b* is connected to the outer cylindrical surface of the main body 52, and the point d' represents the position where the side edge 51*c* is connected to the outer cylindrical surface of the main body 52. The protruding height H1 is a maximum length of the protruding portion 51 in the axial direction of the center electrode 30.

FIG. 3 is a table showing dimensions of test samples of the noble metallic firing tip used in the evaluation test. Each test sample is made of Ir-10Rh, and is 0.7 mm in diameter (D) and 0.8 mm in height (H0).

The evaluation test was conducted on a practical vehicle installing each test sample and subjected to a test traveling of $10\times10^4$ km, with periodical checks of ignitability performed every traveling of $2\times10^4$ km. In this evaluation test, firing limit A/F was introduced as a factor reflecting the ignitability. FIG. 4 is a graph showing the transition of ignitability observed every traveling of $2\times10^4$ km. FIG. 5 is a graph showing test result representing a relationship between the protruding length L1 and the ignitability obtained through this evaluation test.

Symbols are commonly used in FIGS. 3, 4 and 5, wherein the test sample indicated by black mark (●) is a conventional firing tip with no protruding portion 51.

As apparent from test results shown in FIGS. 4 and 5, each spark plug having the protruding portion 51 has demonstrated excellent ignitability in an initial stage of its lifetime less than a traveling distance of $4\times10^4$ km where the conventional spark plug could not obtain stable or reliable ignitability.

This is believed that the electric field in the discharge gap is relatively strong at the local portion where the protruding portion 51 is formed. Thus, the flame kernel is formed at the distal end side of the ground electrode 40 during spark discharge. The flame kernel can promptly and stably grow without being severely subjected to the cooling function of the ground electrode 40 including its leg portion 41.

Furthermore, as apparent from FIG. 5, it becomes possible to assure excellent ignitability when the protruding length L1 satisfies $0.01\ \text{mm} \leqq L1 \leqq 0.2\ \text{mm}$. Effect of improving the ignitability is enhanced with increasing protruding length L1.

Furthermore, it is preferable that the lengths L2 and L2' of the protruding portion 51 satisfy $0.1 \leqq L2/D \leqq 0.5$ and $0.1 \leqq L2'/D \leqq 0.5$ respectively. It is also preferable that the protruding height H1 satisfies $0.1\ \text{mm} \leqq H1 \leqq 0.3\ \text{mm}$.

FIG. 6 is a table showing dimensions of test samples of the noble metallic firing tip used in another evaluation test. Like the above-described evaluation test, the test samples are differentiated in the protruding length L1, protruding regions L2, L2', and protruding height H1. Each test sample is made of Ir-10Rh but is 0.4 mm in diameter (D) and 0.6 mm in height (H0).

Figure 8:
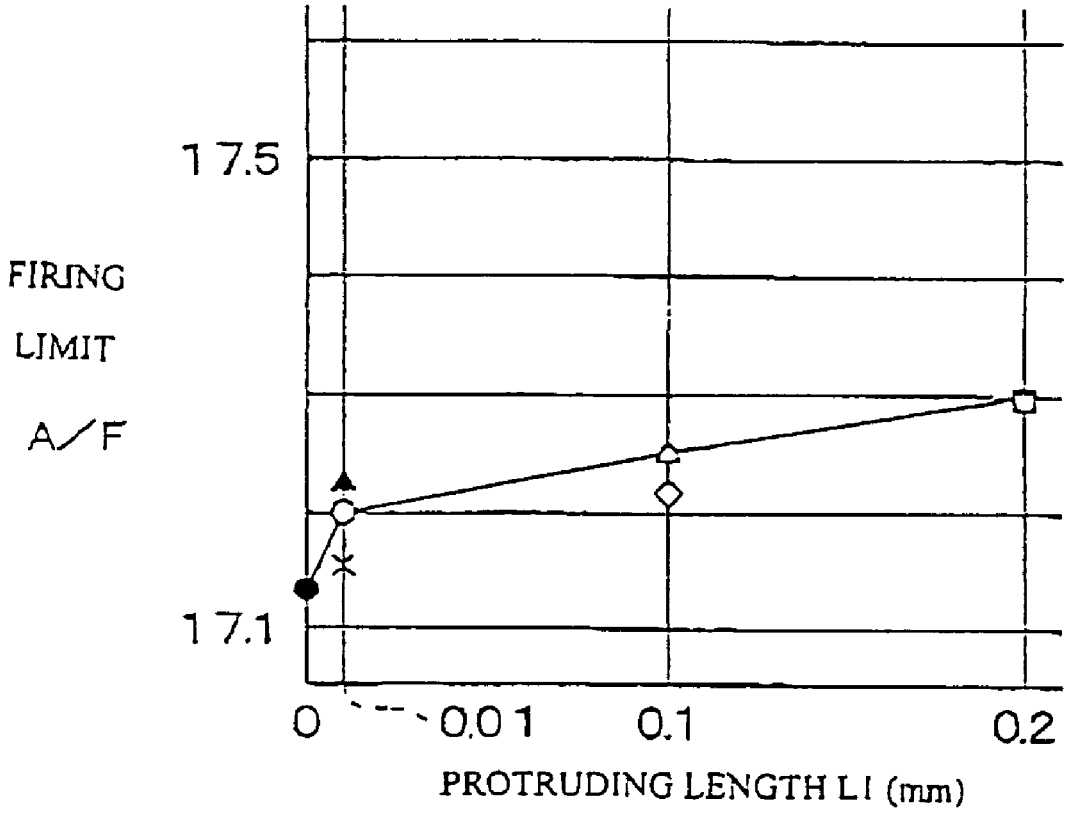
FIG. 8 is a graph showing test result representing a relationship between protruding length and ignitability.

FIG. 7 is a graph showing the transition of ignitability observed every traveling of $2\times10^4$ km. FIG. 8 is a graph showing test result representing a relationship between the protruding length L1 and the ignitability obtained through this evaluation test. Symbols are commonly used in FIGS. 6, 7 and 8, wherein the test sample indicated by black mark (●) is a conventional firing tip with no protruding portion 51.

As apparent from test results shown in FIGS. 7 and 8, each spark plug having the protruding portion 51 has demonstrated excellent ignitability in an initial stage of its lifetime less than a traveling distance of $4\times10^4$ km where the conventional spark plug could not obtain stable or reliable ignitability. Furthermore, as apparent from FIG. 8, it becomes possible to assure excellent ignitability when the protruding length L1 satisfies 0.01 mm≦L1≦0.2 mm. Effect of improving the ignitability is enhanced with increasing protruding length L1

Furthermore, it is preferable that the lengths L2 and L2' of the protruding portion 51 satisfy 0.1≦L2 /D≦0.5 and 0.1≦L2'/D≦0.5 respectively. It is also preferable that the protruding height H1 satisfies 0.1 mm≦H1≦0.3 mm.

FIGS. 9A to 9E are modified examples of the noble metallic firing tip of a spark plug in accordance with the first embodiment of the present invention, which are differentiated in the shape of protruding portion 51. Each modified noble metallic firing tip functions in substantially the same manner and brings substantially the same effect as those of the above-described firing tip.

Figure 9A:
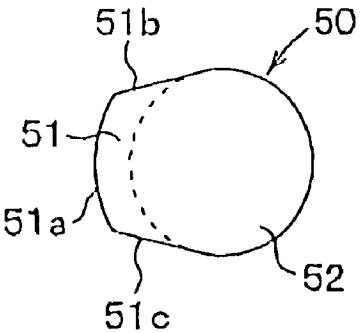
FIGS. 9A to 9E are plan or perspective views showing modified examples of the noble metallic firing tip of a spark plug in accordance with the first embodiment of the present invention.
Figure 9B:
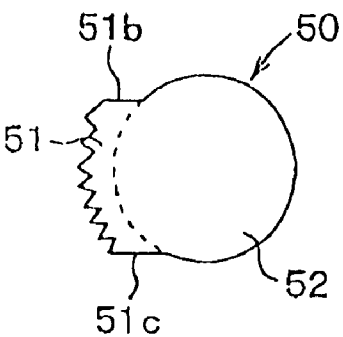
Figure 9C:
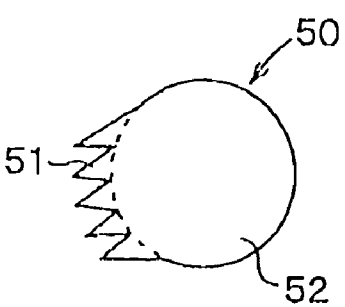

FIGS. 9A to 9C are plan views each showing a modified protruding portion 51 seen from the axial direction of the center electrode 30. According to the embodiment shown in FIG. 9A, the protruding portion 51 has side edges 51*b* and 51*c* being not parallelized to each other and each extending in a tangential direction of the main body 52. According to the embodiment shown in FIG. 9B, the protruding portion 51 has numerous triangular notches along its outermost periphery. According to the embodiment shown in FIG. 9C, the protruding portion 51 has relatively larger triangular notches each having a protruding top and a bottom region aligned on the outer cylindrical surface of the main body 52.

Figure 9D:
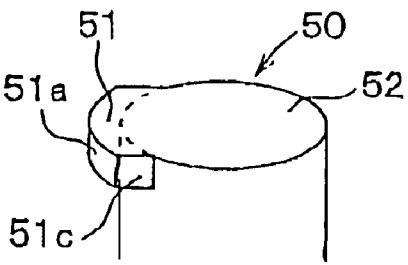
Figure 9E:
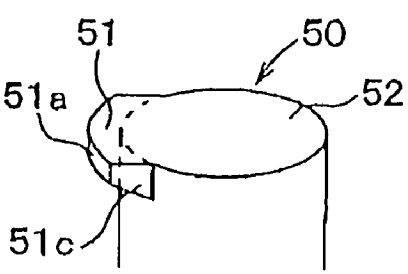

FIGS. 9D and 9E are perspective views each showing a modified protruding portion 51. According to the embodiment shown in FIG. 9D, the protruding portion 51 has a rectangular shape when seen in a vertical cross section including the axis of the center electrode 30. According to the embodiment shown in FIG. 9E, the protruding portion 51 has a tapered (more specifically, truncated rectangular) shape when seen in the vertical cross section including the axis of the center electrode 30.

Second Embodiment

The second embodiment of this invention provides a spark plug having a noble metallic firing tip 150 having two regions differentiated in surface roughness and respectively serving as a discharge surface forming the discharge gap 60. One region of the noble metallic firing tip 150 has a surface roughness larger than that of the other region and is disposed in confronting relationship via the discharge gap 60 with a distal end of the opposed portion 42 of the ground electrode 40 far from the leg portion 41.

Figure 10:
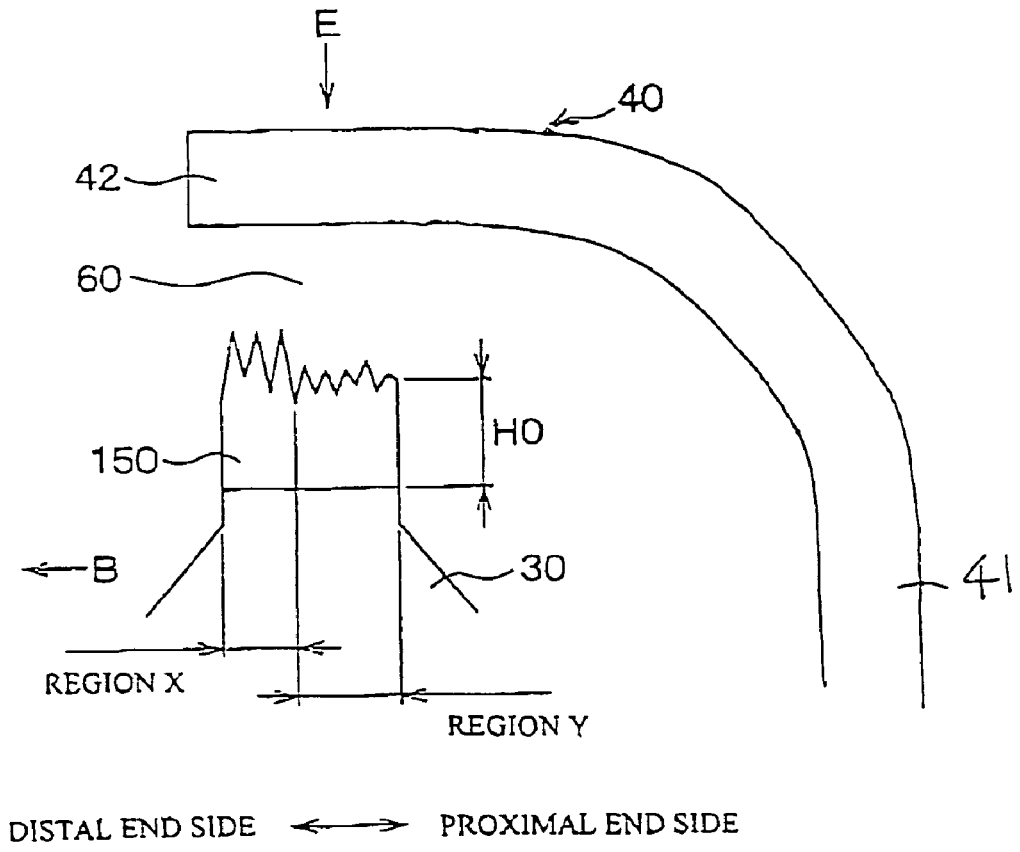
FIG. 10 is a side view showing an essential part of a spark plug in accordance with a second embodiment of the present invention.
Figure 11:
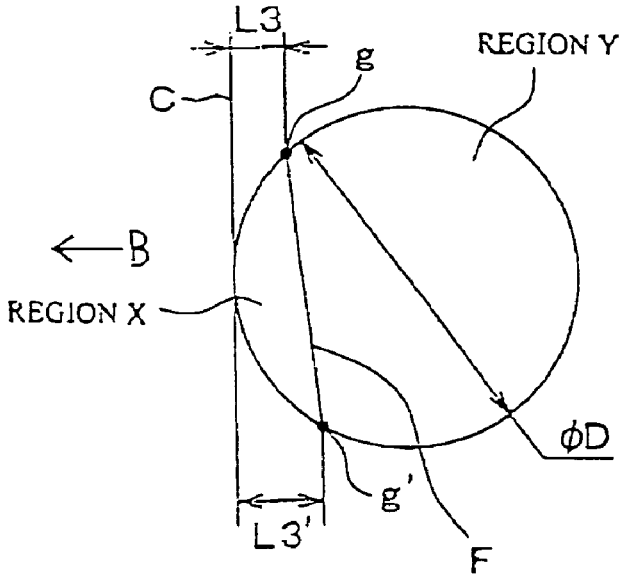
FIG. 11 is a plan view showing a noble metallic firing, tip shown in FIG. 10, seen from the direction of an arrow E.

FIG. 10 is a side view showing an essential part of a spark plug in accordance with a second embodiment of the present invention. FIG. 11 is a plan view showing the noble metallic firing tip 150 shown in FIG. 11, seen from the direction of an arrow E. The second embodiment is identical with the first embodiment in arrangement, except for the noble metallic firing tip 150.

The noble metallic firing tip 150 is formed by shearing a thin and long material rod into a piece having a predetermined length. Through this shearing, two regions mutually differentiated in surface roughness are formed on the noble metallic firing tip 150 so as to serve as the discharge surface forming the discharge gap 60. More specifically, on the discharge surface of the noble metallic firing tip 150, one region X of the noble metallic firing tip 150 is positioned at a leading side in the shearing direction B and the other region Y is positioned at a trailing side. The region X has a surface roughness larger than that of the other region Y. The region X is disposed in confronting relationship via the discharge gap 60 with a distal end of the opposed portion 42 of the ground electrode 40 far from its leg portion 41.

Ignitability of the above-described spark plug was evaluated using various test samples differentiated in filtered maximum waviness difference $\Delta W_{CM}$, lengths L3, L3' of the region X, and surface roughness difference $\Delta R_Z$.

The filtered maximum waviness difference $\Delta W_{CM}$ is equal to a difference between $W_{CM(X)}$ and $W_{CM(Y)}$, i.e., $\Delta W_{CM}=W_{CM(X)}-W_{CM(Y)}$, wherein $W_{CM(X)}$ represents a maximum waviness in a filtered waviness curve in the region X and $W_{CM(Y)}$ represents a maximum waviness in a filtered waviness curve in the region Y.

In FIG. 11, a boundary line F between the leading region X and the trailing region Y crosses the outer cylindrical surface of the noble metallic firing tip 150 at points g and g', and a tangential line C of the noble metallic firing tip 150 is normal to the shearing direction B and passes the leading edge of the noble metallic firing tip 150. One length L3 of the region X is a clearance from the line C to the crossing point g, and the other length L3' is a clearance from the line C to the crossing point g'.

Furthermore, the surface roughness difference $\Delta R_Z$ is equal to a difference between $R_{Z(X)}$ and $R_{Z(Y)}$, i.e., $\Delta R_Z=R_{Z(X)}-R_{Z(Y)}$, wherein $R_{Z(X)}$ represents a ten-point average roughness in the leading region X and $R_{Z(Y)}$ represents a ten-point average roughness in the trailing region Y.

FIG. 12 is a table showing dimensions of test samples of the noble metallic firing tip used in the evaluation test. Each test sample is made of Ir-10Rh, and is 0.7 mm in diameter (D) and 0.8 mm in height (H0).

Figure 13:
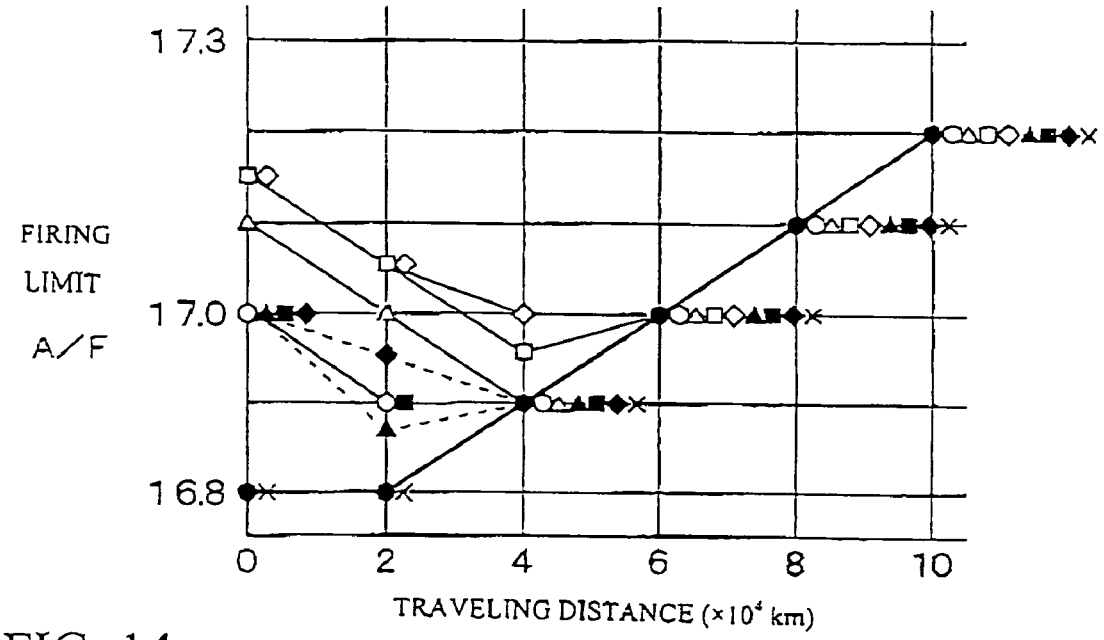
FIG. 13 is a graph showing evaluation result obtained with respect to ignitibility through the evaluation test.
Figure 14:
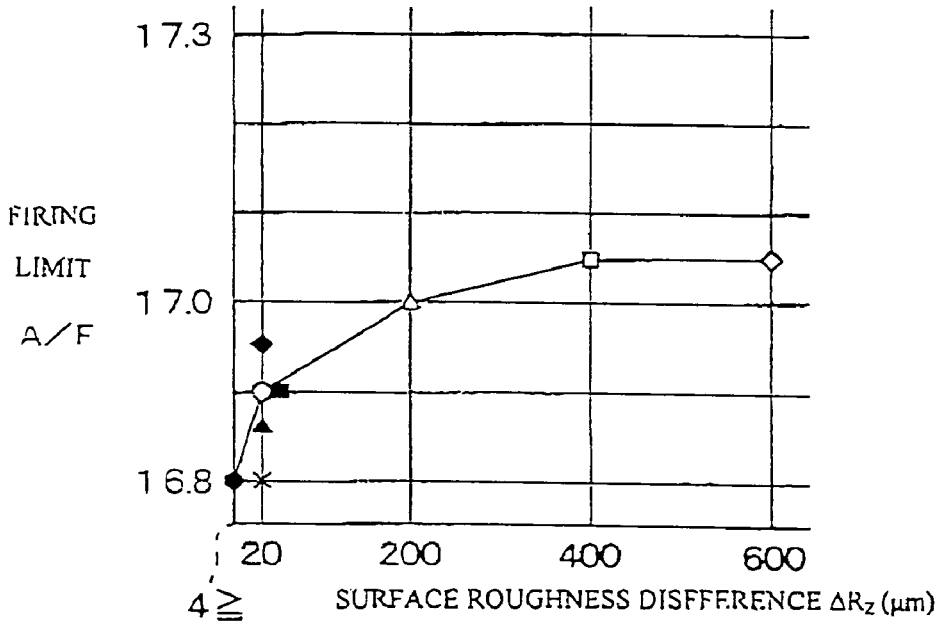
FIG. 14 is a graph showing test result representing a relationship between surface roughness difference and ignitability.

FIG. 13 is a graph showing the transition of ignitability observed every traveling of $2\times10^4$ km. FIG. 14 is a graph showing test result representing a relationship between the surface roughness difference ΔRz and the ignitability obtained through this evaluation test. Symbols are commonly used in FIGS. 12, 13 and 14, wherein the test sample indicated by black mark (●) is a conventional firing tip whose surface roughness difference ΔRz is not greater than 4 μm.

As apparent from test results shown in FIGS. 13 and 14, each of the test samples 1 to 7 has demonstrated excellent ignitability in an initial stage of its lifetime less than a traveling distance of $4\times10^4$ km where the conventional spark plug could not obtain stable or reliable ignitability.

This is believed that the electric field in the discharge gap is relatively strong at the leading region X. Thus, the flame kernel is formed at the distal end side of the ground electrode 40 during spark discharge. The flame kernel can promptly and stably grow without being severely subjected to the cooling function of the ground electrode 40 including its leg portion 41.

However, even if the region X having a larger surface roughness is positioned at the leading side on the discharge surface of noble metallic firing tip 150, the test sample 8 could not demonstrate excellent ignitability because the filtered maximum waviness difference $\Delta W_{CM}$ is a minus value (i.e., −50). This is believed that the electric field in the discharge gap is not always strong at the leading region X when the filtered maximum waviness difference $\Delta W_{CM}$ is a minus value.

From the foregoing, excellent ignitability can be assured when the surface roughness difference ΔRz is greater than 4 μm and the filtered maximum waviness difference $\Delta W_{CM}$ is not a minus value.

Furthermore, it is preferable that the lengths L3 and L3' of the region X satisfy 0.1≦L3 /D≦0.5 and 0.1≦L3'/D≦0.5 respectively.

FIG. 15 is a table showing dimensions of test samples of the noble metallic firing tip used in another evaluation test. Like the above-described evaluation test, the test samples are differentiated in the filtered maximum waviness difference $\Delta W_{CM}$, lengths L3, L3' of the region X, and surface roughness difference ΔRz. Each test sample is made of Ir-10Rh but is 0.4 mm in diameter (D) and 0.6 mm in height (H0).

Figure 16:
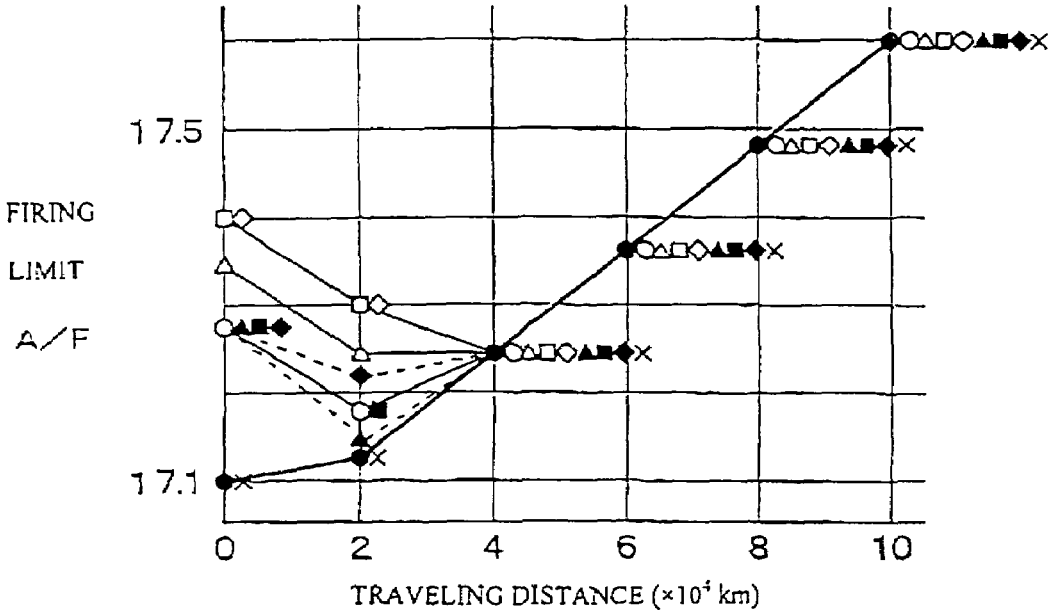
FIG. 16 is a graph showing evaluation result obtained with respect to ignitibility through the evaluation test.
Figure 17:
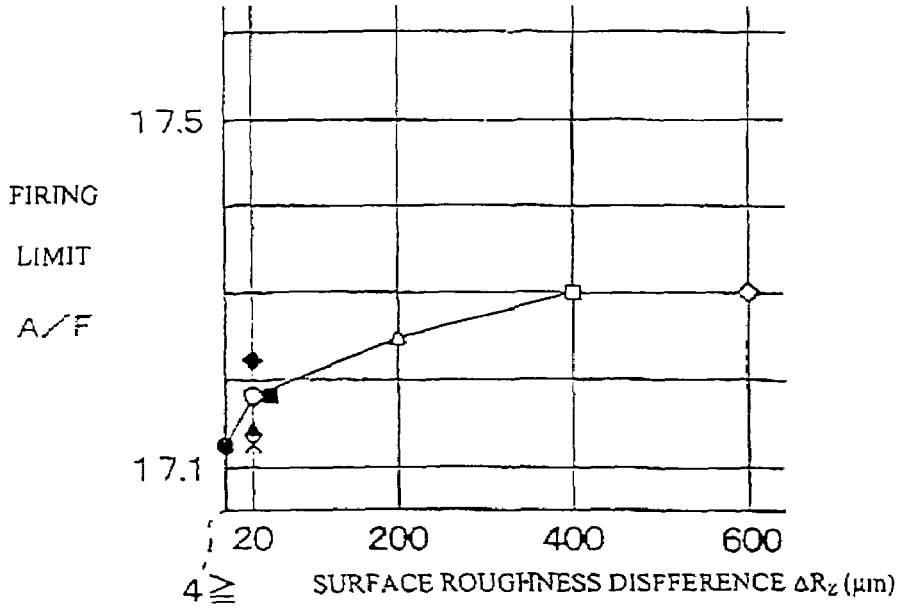
FIG. 17 is a graph showing test result representing a relationship between surface roughness difference and ignitability.

FIG. 16 is a graph showing the transition of ignitability observed every traveling of $2\times10^4$ km. FIG. 17 is a graph showing test result representing a relationship between the surface roughness difference ΔRz and the ignitability obtained through this evaluation test. Symbols are commonly used in FIGS. 15, 16 and 17, wherein the test sample indicated by black mark (●) is a conventional firing tip whose surface roughness difference ΔRz is not greater than 4 $\mu$m.

As apparent from test results shown in FIGS. 16 and 17, each of the test samples 1 to 7 has demonstrated excellent ignitability in an initial stage of its lifetime less than a traveling distance of $4\times10^4$ km where the conventional spark plug could not obtain stable or reliable ignitability. Accordingly, excellent ignitability can be assured when the surface roughness difference ΔRz is greater than 4 $\mu$m and the filtered maximum waviness difference $\Delta W_{CM}$ is not a minus value.

Furthermore, it is preferable that the lengths L3 and L3' of the region X satisfy $0.1 \leqq L3/D = \leqq 0.5$ and $0.1 \leqq L3'/D \leqq 0.5$ respectively.

FIGS. 18A to 18D are plan views showing modified examples of the noble metallic firing tip of a spark plug in accordance with the second embodiment of the present invention, which are differentiated in the shape of boundary line F. Each modified noble metallic firing tip functions in substantially the same manner and brings substantially the same effect as those of the above-described firing tip.

Figure 18A:
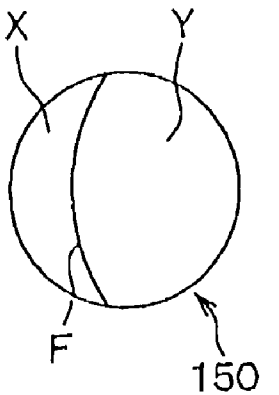
FIGS. 18A to 18D are plan views showing modified examples of the noble metallic firing tip of a spark plug in accordance with the second embodiment of the present invention.
Figure 18B:
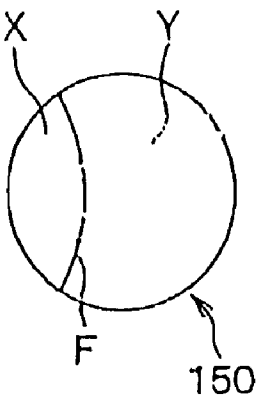
Figure 18C:
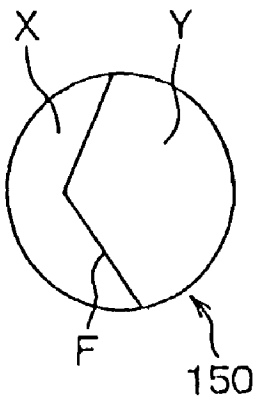
Figure 18D:
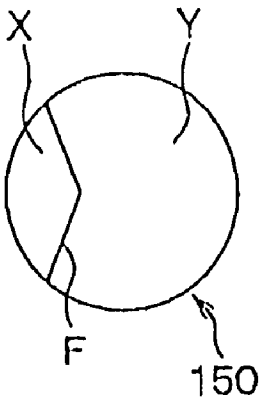

According to the embodiment shown in FIG. 18A, the boundary line F is a curved line leaving a leading region X configured into a concave shape similar to a crescent moon. According to the embodiment shown in FIG. 18B, the boundary line F is an oppositely curved line leaving a leading region X configured into a convex shape. According to the embodiment shown in FIG. 18C, the boundary line F consists of two straight lines inclining from each other so as to leave a leading region X configured into a concave shape. According to the embodiment shown in FIG. 18D, the boundary line F consists of two straight lines oppositely inclining from each other so as to leave a leading region X configured into a convex shape.

Third Embodiment

The third embodiment of this invention provides a spark plug having a noble metallic firing tip 250 having a chamfered portion 253 which is formed partly along an outer cylindrical periphery of its discharge surface and positioned closely to the leg portion 41 of the ground electrode 40.

Figure 19:
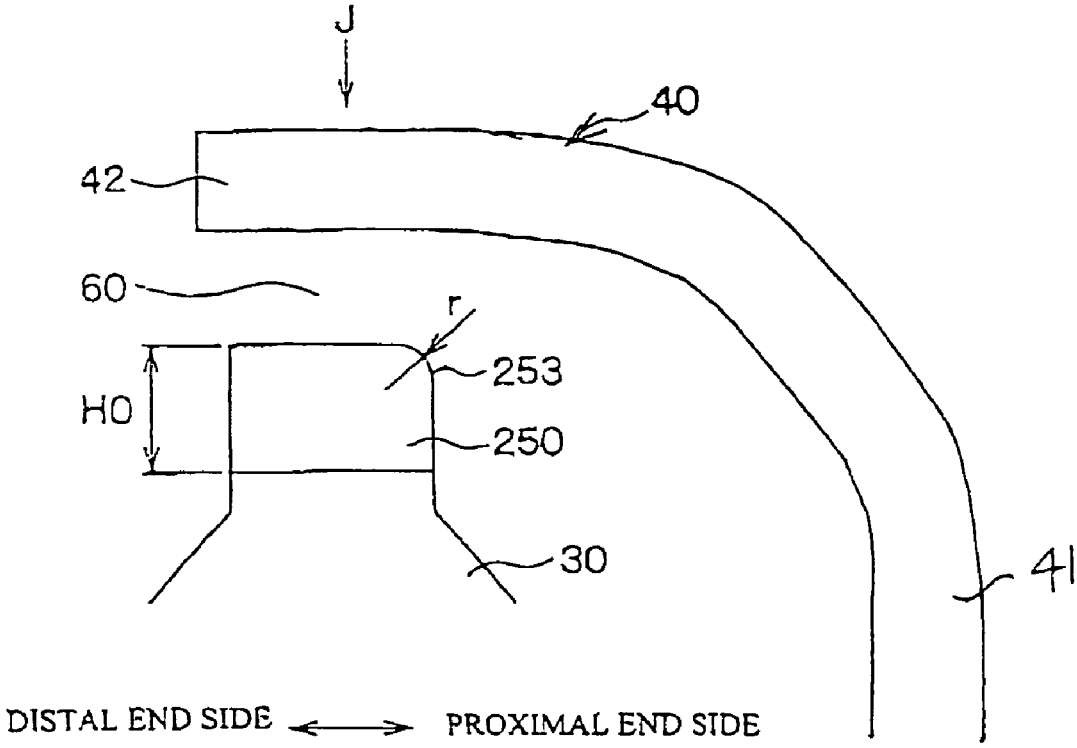
FIG. 19 is a side view showing an essential part of a spark plug in accordance with a third embodiment of the present invention.
Figure 20:
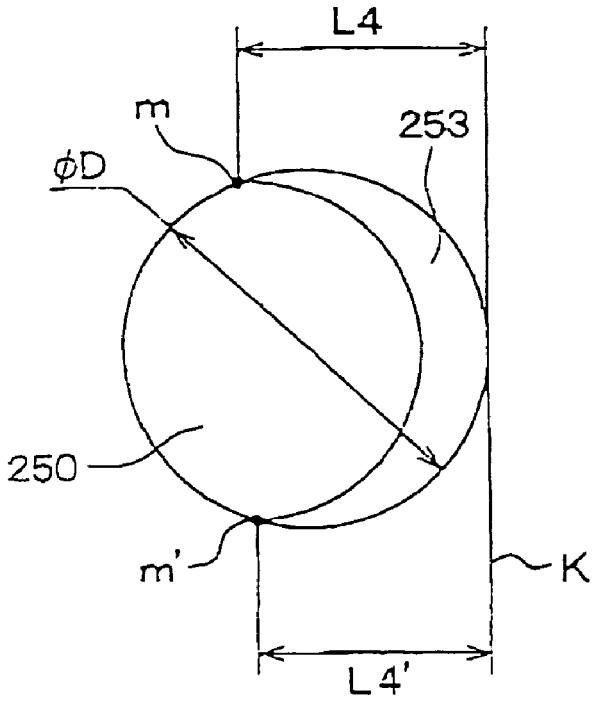
FIG. 20 is a plan view showing a noble metallic firing tip shown in FIG. 19, seen from the direction of an arrow J.

FIG. 19 is a side view showing an essential part of a spark plug in accordance with a third embodiment of the present invention. FIG. 20 is a plan view showing the noble metallic firing tip 250 shown in FIG. 19, seen from the direction of an arrow J. The third embodiment is identical with the first embodiment in arrangement, except for the noble metallic firing tip 250.

When seen in a cross section including the axis of the center electrode 30, the chamfered portion 253 is curved. A curvature radius r of the chamfered portion 253 is maximum at a rear end of noble metallic firing tip 250 (i.e., at a point closest to the leg portion 41 of the ground electrode 40) and decreases with approaching distance to a front end of the noble metallic firing tip 250 (i.e., at a point confronting via discharge gap 60 with the opposed portion 42 of the ground electrode 40).

The noble metallic firing tip 250 is formed by shearing a thin and long material rod into a piece having a predetermined length. Through this shearing, the chamfered portion 253 is formed along the outer cylindrical periphery of the discharge surface forming the discharge gap 60 Ignitability of the above-described spark plug was evaluated using various test samples differentiated in maximum curvature radius r·max and lengths L4, L4' of the chamfered portion 253.

In FIG. 20, a tangential line K of the noble metallic firing tip 250 passes the rear end of noble metallic firing tip 250 closest to the leg portion 41 of the ground electrode 40. The tangential line K is normal to a plane including the axis of the ground electrode 40. One end of the chamfered portion 253 terminates at a point m of the noble metallic firing tip 250, and the other end of the chamfered portion 253 terminates at a point m' of the noble metallic firing tip 250. One length L4 of the chamfered portion 253 is a clearance from the line K to the terminating point m and the other length L4' is a clearance from the line K to the terminating point m'.

FIG. 21 is a table showing dimensions of test samples of the noble metallic firing tip used in the evaluation test. Each test sample is made of Ir-10Rh, and is 0.7 mm in diameter (D) and 0.8 mm in height (H0).

FIG. 22 is a graph showing the transition of ignitability observed every traveling of $2\times10^4$ km. FIG. 23 is a graph showing test result representing a relationship between the maximum curvature radius r·max and the ignitability obtained through this evaluation test. Symbols are commonly used in FIGS. 21, 22 and 23, wherein the test sample indicated by black mark (●) is a conventional firing tip with no chamfered portion 253.

As apparent from test results shown in FIGS. 22 and 23, each test sample having the chamfered portion 253 has demonstrated excellent ignitability in an initial stage of its lifetime less than a traveling distance of $4\times10^4$ km where the conventional spark plug could not obtain stable or reliable ignitability.

This is believed that the electric field in the discharge gap is relatively weak at the chamfered portion 253. Thus, the flame kernel is formed at the distal end side of the ground electrode 40 during spark discharge. The flame kernel can promptly and stably grow without being severely subjected to the cooling function of the ground electrode 40 including its leg portion 41.

Furthermore, as apparent from FIG. 23, it becomes possible to assure excellent ignitability when the maximum curvature radius r·max satisfies $0.05\ \text{mm} \leqq r\cdot\max$. Effect of improving the ignitability is enhanced with increasing maximum curvature radius r·max.

FIG. 24 is a table showing dimensions of test samples of the noble metallic firing tip used in another evaluation test. Like the above-described evaluation test, the test samples were differentiated in the maximum curvature radius r·max and lengths L4, L4' of the chamfered portion 253. Each test sample is made of Ir-10Rh but is 0.4 mm in diameter (D) and 0.6 mm in height (H0).

FIG. 25 is a graph showing the transition of ignitability observed every traveling of $2\times10^4$ km. FIG. 26 is a graph showing test result representing a relationship between the maximum curvature radius r·max and the ignitability obtained through this evaluation test. Symbols are commonly used in FIGS. 24, 25, and 26, wherein the test sample indicated by black mark (●) is a conventional firing tip with no chamfered portion 253.

As apparent from test results shown in FIGS. 25 and 26, each spark plug having the chamfered portion 253 has demonstrated excellent ignitability in an initial stage of its lifetime less than a traveling distance of $4\times10^4$ km where the conventional spark plug could not obtain stable or reliable ignitability. Furthermore, as apparent from FIG. 26, it becomes possible to assure excellent ignitability when the maximum curvature radius r·max satisfies 0.05 mm≦r·max. Effect of improving the ignitability is enhanced with increasing maximum curvature radius r·max.

Figure 27A:
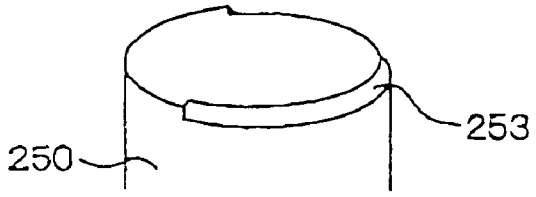
FIGS. 27A and 27B are perspective views showing modified examples of the noble metallic firing tip of a spark plug in accordance with the third embodiment of the present invention.
Figure 27B:
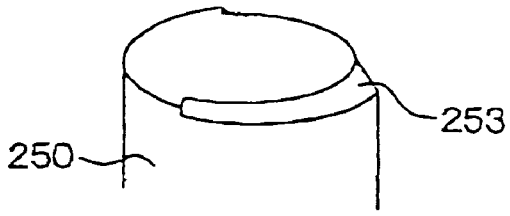

FIGS. 27A and 27B are modified examples of the noble metallic firing tip of a spark plug in accordance with the third embodiment of the present invention, which are differentiated in the shape of chamfered portion 253. Each modified noble metallic firing tip functions in substantially the same manner and brings substantially the same effect as those of the above-described firing tip.

FIGS. 27A and 27B are perspective views each showing a modified chamfered portion 353. According to the embodiment shown in FIG. 27A, the chamfered portion 353 is flattened and not curved in the cross section including the axis of the center electrode 30. The width of chamfered portion 353 is constant. According to the embodiment shown in FIG. 27B, the chamfered portion 353 is flattened and not curved in the cross section including the axis of the center electrode 30. The width of chamfered portion 353 is maximum at the rear end of noble metallic firing tip 250 (i.e., at the point closest to the leg portion 41 of the ground electrode 40) and decreases with approaching distance to the front end of the noble metallic firing tip 250 (i.e., at the point confronting via discharge gap 60 with the opposed portion 42 of the ground electrode 40).

Other Modifications

It is possible to provide each of the above-described noble metallic firing tips 50, 150, and 250 on the ground electrode 40, not on the center electrode 30. Alternatively, it is preferable to provide the above-described noble metallic firing tips 50, 150, and 250 on both of the center electrode 30 and the ground electrode 40.

Each of the noble metallic firing tips 50, 150, and 250 can be made of a Pt alloy. When the noble metallic firing tips 50, 150, and 250 are provided on both of the center electrode 30 and the ground electrode 40, it is possible to use both a noble metallic firing tip made of an Ir alloy and a noble metallic firing tip made of a Pt alloy.

Furthermore, it is preferable to combine any two or all of the above-described first to third embodiments.

What is claimed is:

1. A spark plug comprising:

a cylindrical metal housing;

a columnar center electrode insulated from said metal housing and supported inside said metal housing;

a ground electrode having a leg portion extending substantially parallel to an axis of said center electrode and bonded to said metal housing at one end, and an opposed portion extending from the other end of said leg portion in a direction substantially normal to the axis of said center electrode so as to be opposed to a distal end of said center electrode; and a columnar noble metallic firing tip bonded to at least one of the distal end of said center electrode and the opposed portion of said ground electrode so as to form a discharge gap, wherein said noble metallic firing tip includes a protruding portion formed partly on an outer circumferential surface of said noble metallic firing tip so as to protrude in the direction substantially normal to the axis of said center electrode, and said protruding portion is disposed in confronting relationship via said discharge gap with a distal end of said opposed portion of said ground electrode far from said leg portion.

2. The spark plug in accordance with claim 1, wherein a protruding length L1 of said protruding portion satisfies 0.01 mm≦L1≦0.2 mm.

3. The spark plug in accordance with claim 1, wherein said noble metallic firing tip is made of an iridium (Ir) alloy or a platinum (Pt) alloy.

4. The spark plug in accordance with claim 1, wherein said noble metallic firing tip is formed by shearing a material rod into a piece having a predetermined length.

5. A spark plug comprising:

a cylindrical metal housing;

a columnar center electrode insulated from and supported inside said metal housing;

a ground electrode having a leg portion extending substantially parallel to an axis of said center electrode and bonded to said metal housing at one end, and an opposed portion extending from the other end of said leg portion in a direction substantially normal to the axis of said center electrode so as to be opposed to a distal end of said center electrode; and a columnar noble metallic firing tip bonded to at least one of the distal end of said center electrode and the opposed portion of said ground electrode so as to form a discharge gap, wherein said noble metallic firing tip has two regions differentiated in surface roughness and respectively serving as a discharge surface forming said discharge gap, and one region of said noble metallic firing tip has a surface roughness larger than that of the other region and is disposed in confronting relationship via said discharge gap with a distal end of said opposed portion of said ground electrode far from said leg portion.

6. The spark plug in accordance with claim 5, wherein a surface roughness difference between said two regions of said noble metallic firing tip exceeds 4 $\mu$m in a ten-point average roughness.

7. The spark plug in accordance with claim 5, wherein said noble metallic firing tip is made of an iridium (Ir) alloy or a platinum (Pt) alloy.

8. The spark plug in accordance with claim 5, wherein said noble metallic firing tip is formed by shearing a material rod into a piece having a predetermined length.

* * * * *